US009532625B2

(12) United States Patent
Katz et al.

(10) Patent No.: US 9,532,625 B2
(45) Date of Patent: Jan. 3, 2017

(54) ATHLETIC SHOE

(71) Applicant: EKTIO INC., New York, NY (US)

(72) Inventors: Barry H. Katz, Bridgewater, NJ (US); Omar S. Bailey, New York, NY (US)

(73) Assignee: EKTIO INC., New York, NY (US)

( * ) Notice: Subject to any disclaimer, the term of this patent is extended or adjusted under 35 U.S.C. 154(b) by 152 days.

(21) Appl. No.: 14/166,346

(22) Filed: Jan. 28, 2014

(65) Prior Publication Data

US 2014/0196317 A1 Jul. 17, 2014

Related U.S. Application Data

(63) Continuation-in-part of application No. PCT/US2012/067231, filed on Nov. 30, 2012.

(60) Provisional application No. 61/565,677, filed on Dec. 1, 2011, provisional application No. 61/788,126, filed on Mar. 15, 2013.

(51) Int. Cl.

| | |
|---|---|
| ***A43B 7/20*** | (2006.01) |
| ***A43B 13/14*** | (2006.01) |
| ***A43B 23/07*** | (2006.01) |
| ***A43C 1/00*** | (2006.01) |
| ***A43C 11/00*** | (2006.01) |
| ***A43C 11/14*** | (2006.01) |

(52) U.S. Cl.

CPC . *A43C 1/00* (2013.01); *A43B 7/20* (2013.01); *A43B 13/145* (2013.01); *A43B 23/07* (2013.01); *A43C 11/008* (2013.01); *A43C 11/1493* (2013.01)

(58) Field of Classification Search

CPC ..... A43B 1/0081; A43B 7/20; A43B 13/145; A43B 23/07; A43B 23/26; A43C 1/00; A43C 11/008; A43C 11/14; A43C 11/1493

USPC ..... 36/50.1, 55, 89, 103, 132, 25 R

See application file for complete search history.

(56) References Cited

U.S. PATENT DOCUMENTS

| | | | | |
|---|---|---|---|---|
| 5,109,613 A | | 5/1992 | Van Dyke | |
| 5,269,078 A | * | 12/1993 | Cochrane | A43B 5/00 36/170 |
| 5,317,820 A | * | 6/1994 | Bell | A43B 5/00 36/114 |
| 5,333,398 A | * | 8/1994 | Seo | A43C 7/00 24/712.9 |

(Continued)

FOREIGN PATENT DOCUMENTS

| | | |
|---|---|---|
| WO | WO 2008/050533 A1 | 5/2008 |
| WO | WO 2013/082385 A1 | 6/2013 |

OTHER PUBLICATIONS

International Search Report for PCT/US2012/67231, mailed Feb. 15, 2013.

*Primary Examiner* — Khoa Huynh
*Assistant Examiner* — Sharon M Prange
(74) *Attorney, Agent, or Firm* — Greenberg Traurig, LLP

(57) ABSTRACT

An athletic shoe includes stabilization mechanisms designed to inhibit ankle sprains while also providing comfort for a wearer. Such mechanisms include inner and outer straps that overlie the instep of the athletic shoe and wrap around the wearer's ankle to provide ankle support and inhibit inversion of the ankle during athletic activity. The athletic shoe also includes an inner boot liner that stabilizes the wearer's foot within the athletic shoe, provides a comfortable buffer between the wearer's foot and the inner and outer straps, and wicks perspiration away from the wearer's foot during athletic activity.

16 Claims, 16 Drawing Sheets

(56) References Cited

U.S. PATENT DOCUMENTS

| | | | | |
|---|---|---|---|---|
| 5,400,529 | A * | 3/1995 | Bell | A43B 5/00 36/114 |
| 5,651,197 | A | 7/1997 | James | |
| 6,029,376 | A | 2/2000 | Cass | |
| 6,228,043 | B1 * | 5/2001 | Townsend | A43B 5/10 36/69 |
| 6,272,772 | B1 * | 8/2001 | Sherman | A43B 5/16 36/89 |
| 6,772,541 | B1 * | 8/2004 | Ritter | A43B 7/14 36/50.1 |
| 6,775,929 | B2 | 8/2004 | Katz et al. | |
| 6,792,702 | B2 | 9/2004 | Borsoi et al. | |
| 7,380,354 | B2 | 6/2008 | Yamashita et al. | |
| D634,918 | S | 3/2011 | Katz et al. | |
| D635,748 | S | 4/2011 | Katz et al. | |
| D656,715 | S | 4/2012 | Katz et al. | |
| 8,302,329 | B2 * | 11/2012 | Hurd | A43B 23/08 36/68 |
| 2008/0307674 | A1 * | 12/2008 | Dean | A43B 3/0031 36/89 |

* cited by examiner

ATHLETIC SHOE

RELATED APPLICATIONS

This application is a continuation-in-part of International Patent Application No. PCT/US2012/067231, filed Nov. 30, 2012, and claims the benefit of (i) the aforementioned international patent application; (ii) U.S. Provisional Patent Application Ser. No. 61/565,677, filed Dec. 1, 2011; and (iii) U.S. Provisional Patent Application Ser. No. 61/788,126, filed Mar. 15, 2013, the disclosures of all of which are incorporated by reference herein in their entirety.

FIELD OF INVENTION

The present invention relates to footwear and, more particularly, to an athletic shoe having certain stabilization mechanisms and safety supports to inhibit ankle sprains while providing comfort to the wearer.

BACKGROUND OF THE INVENTION

The lateral ankle sprain is the most common injury in basketball players and one of the most common overall sports injuries seen in medical emergency rooms. While this injury is most common for basketball players, it often occurs in other sports which involve jumping, and running with sharp cuts. These sports include, but are not limited to, soccer, football, volleyball, cross-country running, tennis, track, lacrosse, and baseball, as well as other activities.

The most common mechanism of injury in basketball is a player jumping up and landing on an uneven surface, often another player's shoe, such that the foot is generally in plantar flexion and inverted. When the vertically loaded lateral forces exceed the everting muscles of the lower leg, the lateral ligaments tear. The anterior talofibular ligament is the most commonly injured ligament, followed by the calcaneofibular ligament and the posterior talofibular ligament.

In the other sports described above, similar vertical loading also can occur. For example, excessive force can be applied to the medial ankle, such as when a baseball player slides into another player's ankle or when a soccer player "slide tackles" another to steal the ball.

While athletic shoes have become increasingly stylish, they have not been able to reduce the incidence of lateral ankle sprains. In fact, the nature of the design of shoes with a hard sole with firm medial and lateral edges in conjunction with a soft upper portion actually contributes to, and often exacerbates, the problems of lateral instability described above. When an ankle inverts in plantar flexion, the point of landing is on the hard lateral edge of the sports shoe, especially when a vertical load is applied when landing from a jump. The relatively softer upper portion of the shoe connected to the hard lower sole bends on an acute angle. This causes apposition of the medial part of the shoe with the medial ankle and a wide gap that forms between the soft upper shoe and the lateral ankle. It is this "disconnect" that develops between the shoe and the lateral ankle that leads to a lack of support. The forces are entirely placed on the lateral ligaments (described above) which subsequently tear, as they cannot support the full weight of the body landing on them.

A number of athletic shoes have been provided to alleviate the above concerns regarding ankle and foot inversion. One such shoe is described in U.S. Pat. No. 6,775,929 B2, the disclosure of which is incorporated by reference herein in its entirety. The present invention provides a number of improvements upon such athletic shoes, as will be described in further detail below.

SUMMARY OF THE INVENTION

According to one embodiment of the present invention, an athletic shoe is provided with a stabilization mechanism that stabilizes a wearer's foot and ankle therein to prevent lateral ankle inversion while providing comfort to the wearer. The shoe includes a plurality of straps for wrapping around the wearer's foot and ankle within the shoe. The straps are detachably fastenable, such that a wearer may detach and reattach each strap when each one becomes loosened through use.

The shoe also includes an inner boot liner that accommodates a wearer's foot inside the shoe. The inner boot liner is located inside the shoe and provides structural support for holding the straps up and adjacent to the inside walls of the shoe. The inner boot liner facilitates putting the shoe on and provides comfort to the wearer by creating a buffer between the wearer's foot and the portions of the straps inside the shoe, thereby preventing the straps from making contact with, and irritating, the skin of the wearer's foot and ankle. The inner boot liner also functions to stabilize the wearer's foot within the shoe by restricting the foot's freedom to move laterally between the walls of the shoe.

The shoe further includes a plurality of stabilizing lateral bumper supports, which are attached to the lateral side of the shoe's sole and provide additional lateral support for preventing lateral inversion of the wearer's ankle. The bumper supports are made from a softer material compared to the sole's material to provide cushioning and absorb shock when a wearer jumps and touches down. The bumper supports are slightly elevated from the bottom of the shoe's sole to inhibit wear and prevent them from becoming weight-bearing portions of the shoe. In one embodiment, the bumper supports are detachable and replaceable in the event that they become worn. In another embodiment, the bumper supports may be loaded with weights for the purpose of weight training.

BRIEF DESCRIPTION OF THE DRAWINGS

For a more complete understanding of the present invention, reference is made to the following detailed description of three exemplary embodiments considered in conjunction with the accompanying drawings, in which.

DETAILED DESCRIPTION OF THE INVENTION

Figure 1:
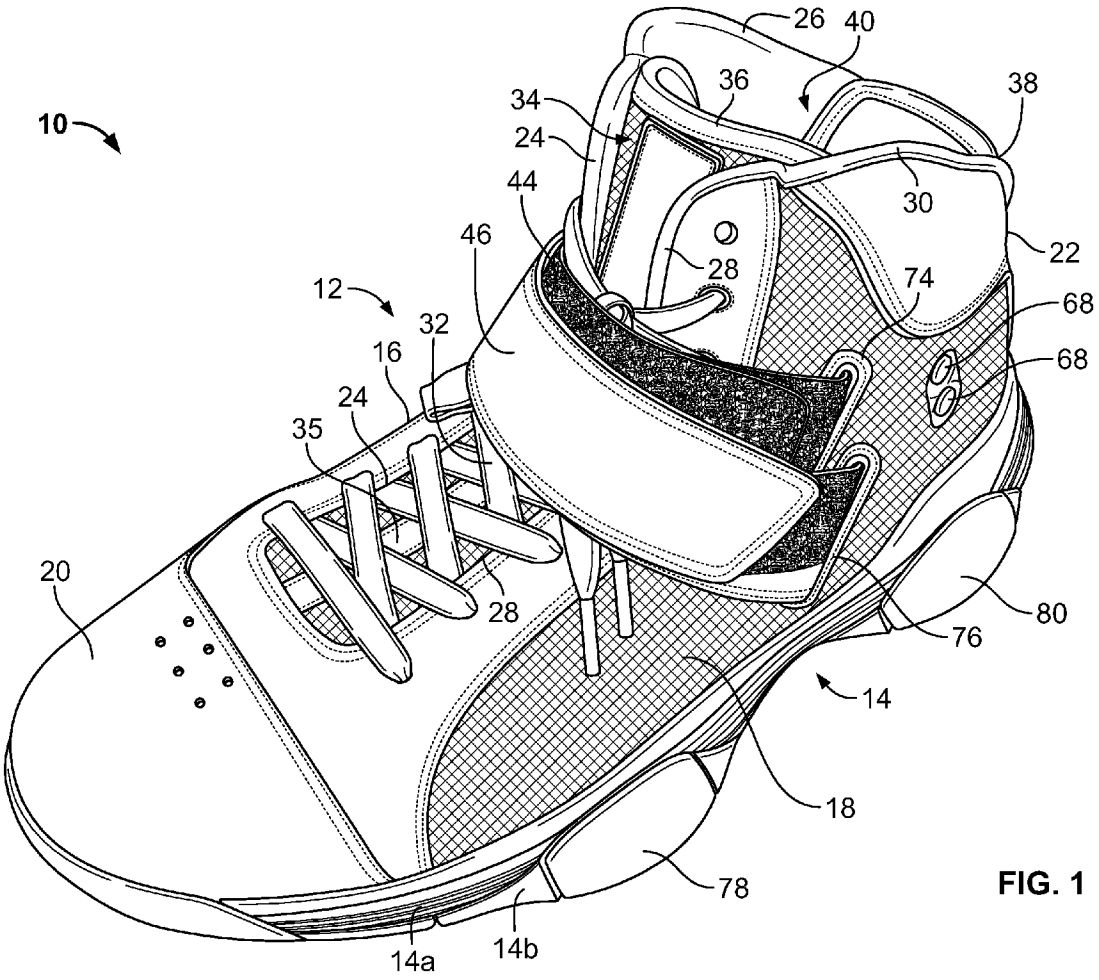
FIG. 1 is a perspective view of the lateral side of an athletic shoe in accordance with a first embodiment of the present invention.
Figure 2:
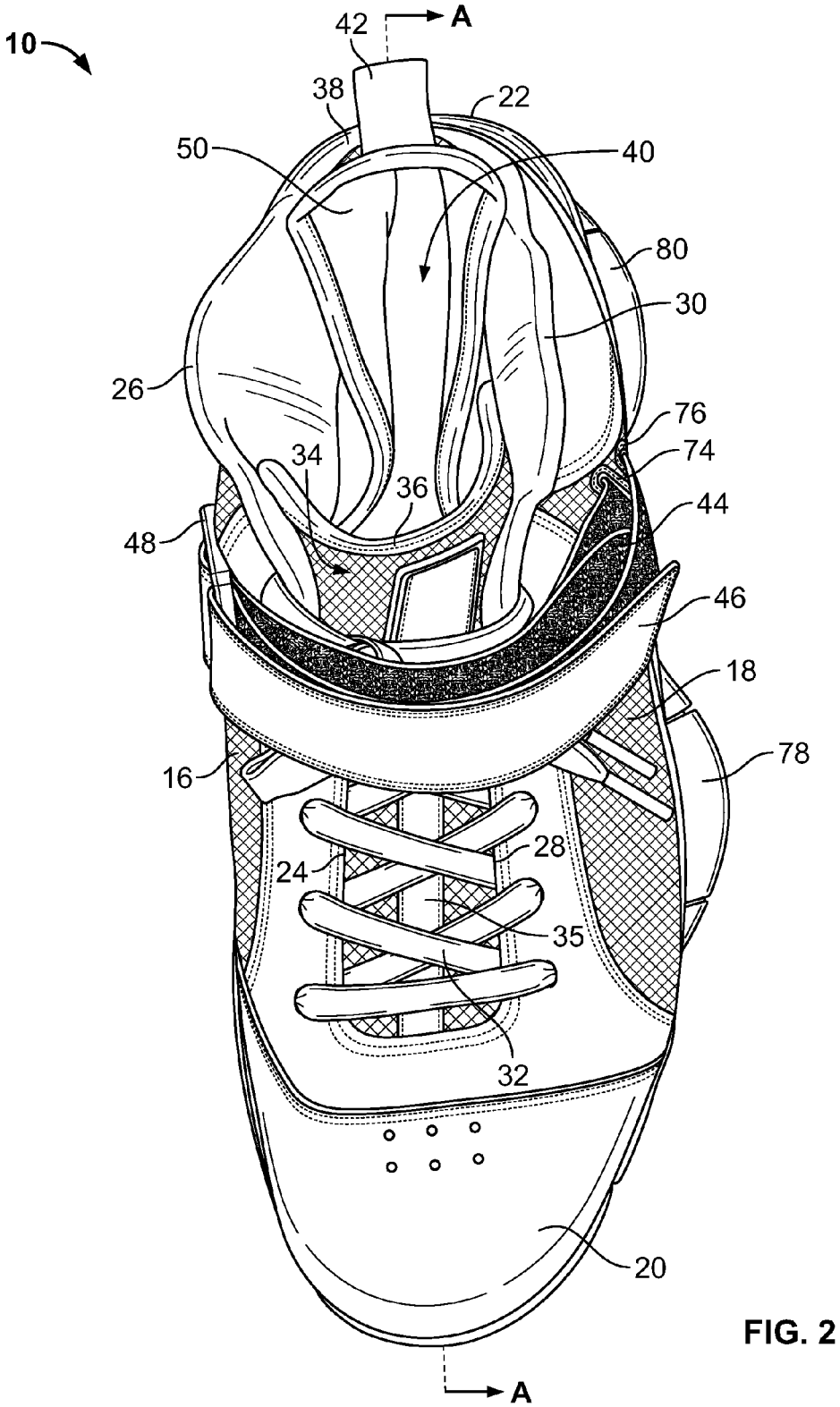
FIG. 2 is a top plan view of the athletic shoe shown in FIG. 1.
Figure 3:
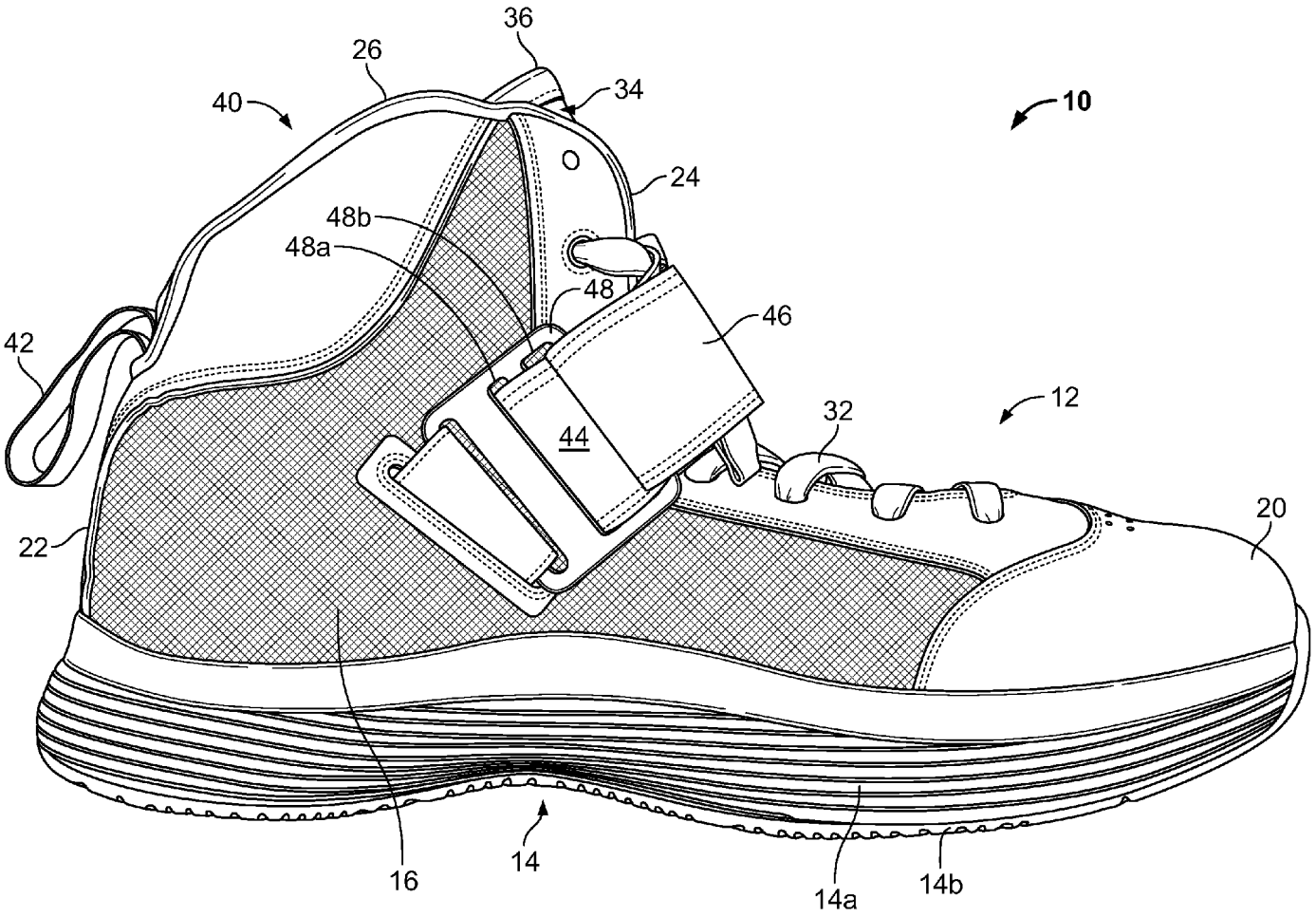
FIG. 3 is an elevational view of the medial side of the athletic shoe shown in FIG. 1.

FIGS. 1-7 illustrate an athletic shoe 10 constructed in accordance with a first embodiment of the present invention. With reference to FIGS. 1-3, the shoe 10 includes an upper 12 and a sole 14, which is fixedly attached to the upper 12 and includes a midsole 14*a* and an outsole 14*b*. The upper 12 has a medial wall 16 on the medial side of the shoe 10 and a lateral wall 18 on the lateral side of the shoe 10, both of which join at the anterior end of the shoe 10 to form a toe 20 and at the posterior end of the shoe 10 to form a heel 22. The medial wall 16 has a medial instep edge 24 proximate the toe 20 and a medial ankle edge 26 proximate the heel 22. Likewise, the lateral wall 18 has a lateral instep edge 28 proximate the toe 20 and a lateral ankle edge 30 proximate the heel 22. The medial and lateral instep edges 24, 28 form the instep of the shoe 10, and can be secured in proximity to each other by a shoelace 32 to create an enclosure around a wearer's foot when the shoe 10 is in use.

Figure 4:
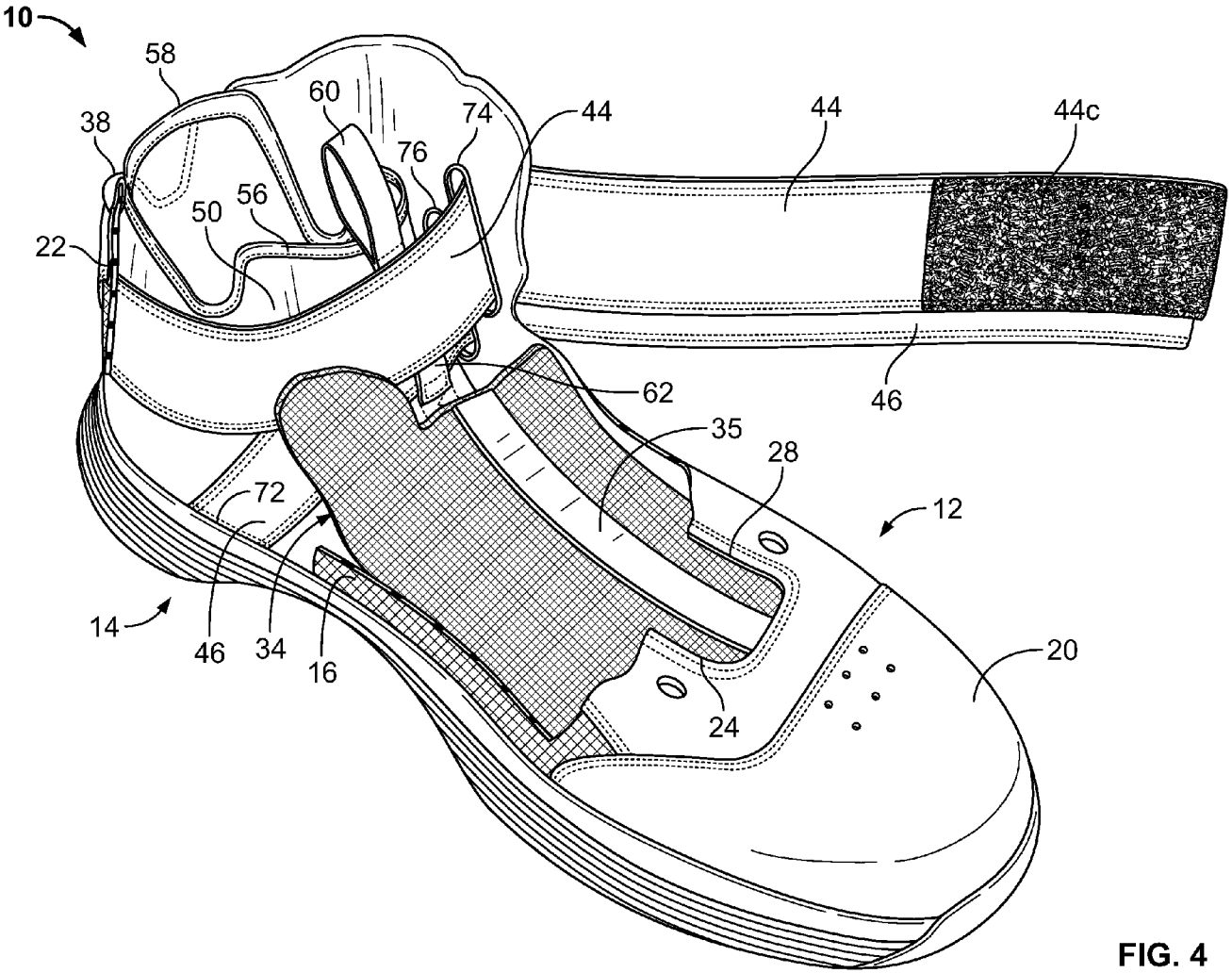
FIG. 4 is a perspective view of the medial side of the athletic shoe shown in FIG. 3 with cutaways showing portions of the tongue and the inner boot liner of the shoe.

Now referring to FIGS. 1 and 4, the shoe 10 also includes a tongue 34 having a center tongue strip 35. The tongue 34 is attached to the upper 12 proximate the toe 20 at one end and extends along the medial and lateral instep edges 24, 28 to a tongue edge 36 proximate the medial and lateral ankle edges 26, 30, as shown in FIG. 1. The center tongue strip 35 extends the length of the tongue 34 and is sewn into the material of the tongue 34 from a point proximate from the toe 20 to the tongue edge 36. In one embodiment, the portion of the center tongue strip 35 proximate the tongue edge 36 is widened to accommodate the placement of a product label or trademark. In another embodiment, a portion of the center tongue strip 35 is separated from the tongue 34 to create a loop that is sized and shaped to accommodate and secure a support strap to the tongue 34 (see FIG. 9 and its associated discussion below).

With reference to FIGS. 1-4, the heel 22 of the upper 12 has a heel edge 38 formed by the connection of the medial ankle edge 26 and the lateral ankle edge 30 opposite the tongue edge 36. The medial and lateral ankle edges 26, 30, the tongue edge 36 and the heel edge 38 form a foot opening 40, in which a wearer may place his or her foot to wear the shoe 10. The heel edge 38 also includes a heel finger loop 42, which is used to assist the wearer in putting on the shoe, as will be discussed in further detail below.

With reference to FIGS. 1-3, the shoe 10 includes an inner strap 44 and an outer strap 46, both of which overlie the instep of the shoe 10 (i.e., the medial and lateral instep edges 24, 28). The shoe 10 also includes a buckle 48, which is attached to the medial wall 16 and includes a lower buckle slot 48*a* and an upper buckle slot 48*b*, through which the inner and outer straps 44, 46 pass in order to secure the wearer's foot to the shoe 10. The inner and outer straps 44, 46 simulate the structure and characteristics of athletic tape in order to provide ankle support to the wearer of the shoe 10 without compromising comfort. Accordingly, the inner and outer straps 44, 46 are each made of a strong, smooth, durable, non-elastic material having a high tensile strength and a low propensity for fatigue, such as nylon or other comparable materials. Additional details regarding the construction and orientation of the inner and outer straps 44, 46 are discussed further below.

With reference to FIGS. 2 and 4-7, the shoe 10 further includes an inner boot liner 50 located inside the shoe 10. The inner boot liner 50 is sized and shaped to accommodate the wearer's foot while providing structural support for holding up the inner and outer straps 44, 46 inside the shoe 10. The inner boot liner 50 is made of a soft, flexible material having some elasticity, such as neoprene, such that it may conform to the shape of the wearer's foot. The inner boot liner 50 provides a comfortable buffer between the top of the wearer's foot and the inner and outer straps 44, 46 of the shoe 10, thereby allowing the inner and outer straps 44, 46 to be cinched against the wearer's ankle and foot without causing discomfort. The inner boot liner 50 also functions to stabilize the wearer's foot within the shoe 10 by resisting the foot's lateral movements between the medial and lateral walls 16, 18 during use. The inner boot liner 50 further diverts (i.e., wicks) perspiration away from the wearer's foot while the wearer is active.

With reference to FIGS. 4-7, the inner boot liner 50 is positioned underneath the tongue 34 and the inner and outer straps 44, 46, and extends laterally between the medial wall 16 and the lateral wall 18. The inner boot liner 50 has a liner toe 52, which is positioned underneath the toe 20 of the shoe 10, and a liner heel 54, which is positioned adjacent to the heel 22 of the shoe (see FIGS. 6 and 7). The inner boot liner 50 also includes a front liner edge 56, which is proximate the tongue edge 36 of the tongue 34 (see FIG. 7), and a rear liner edge 58 opposite the front liner edge 56, which is adjacent and attached to the heel edge 38 of the heel 22. The front liner edge 56 includes a front finger loop 60 which is used to assist the wearer in putting on the shoe 10, as will be discussed in further detail below. The front liner edge 56 also includes an inner boot strap loop 62 located beneath and adjacent to the front finger loop 60 that can accommodate the outer strap 46 while securing it against the inner boot liner 50.

Figure 6:
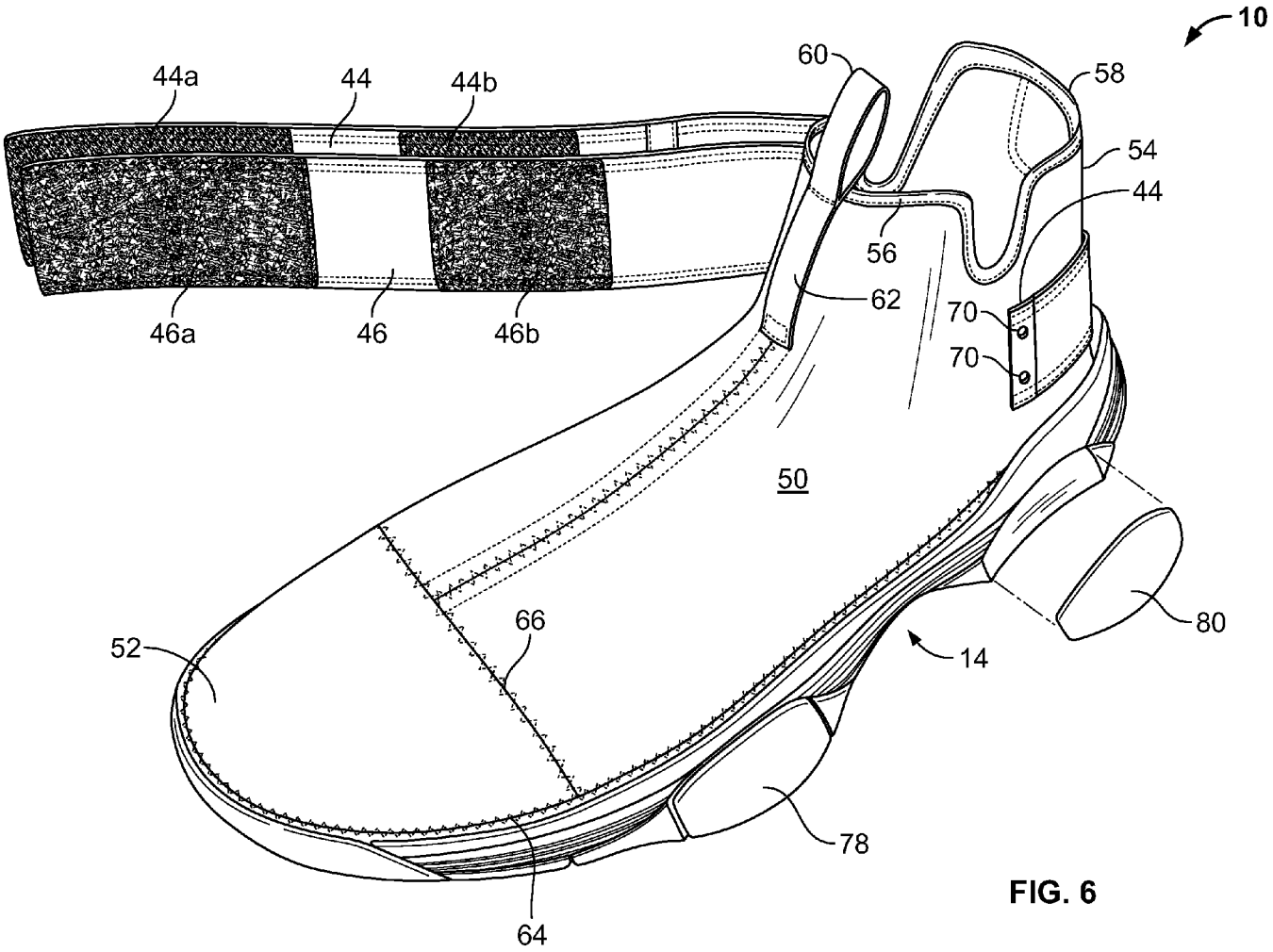
FIG. 6 is the perspective view of FIG. 5, with the upper of the shoe cut away to show the entire inner boot liner of the shoe.
Figure 7:
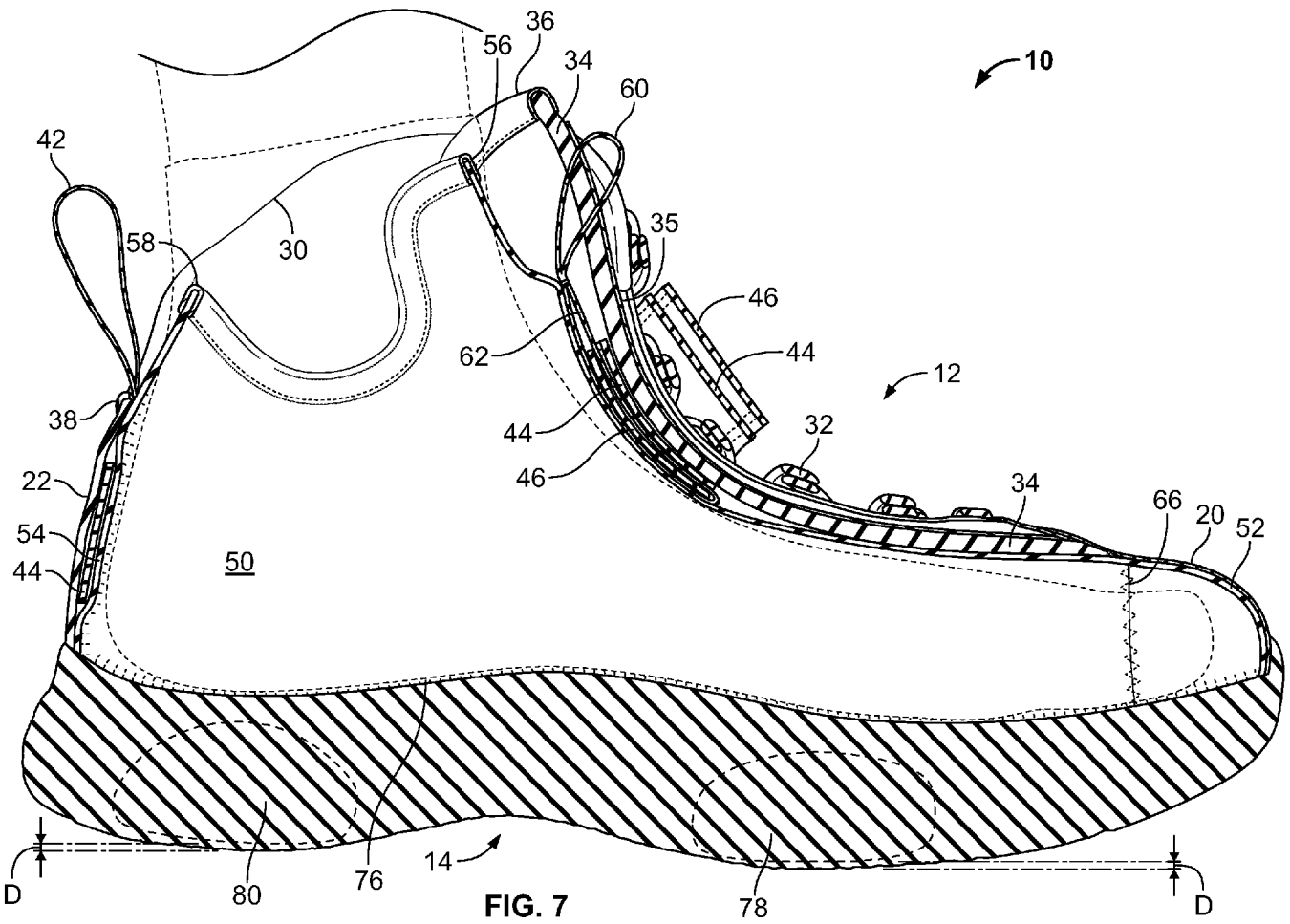
FIG. 7 is a cross-sectional view of the athletic shoe shown in FIG. 2 taken along line A-A and looking in the direction of the arrows, the view showing a wearer's foot in phantom.

With reference to FIGS. 6 and 7, the bottom of the inner boot liner 50 is attached to the sole 14 at the junction of the upper 12 to the sole 14 (i.e., along in-sole seam 64) through techniques commonly known in the art, such as stitching, gluing or molding. The inner boot liner 50 can be further secured to the upper 12 by attaching the liner heel 54 to the heel 22 of the upper 12, as well as by attaching the liner toe 52 to the toe 20 of the upper 12 at toe seam 66.

Figure 5:
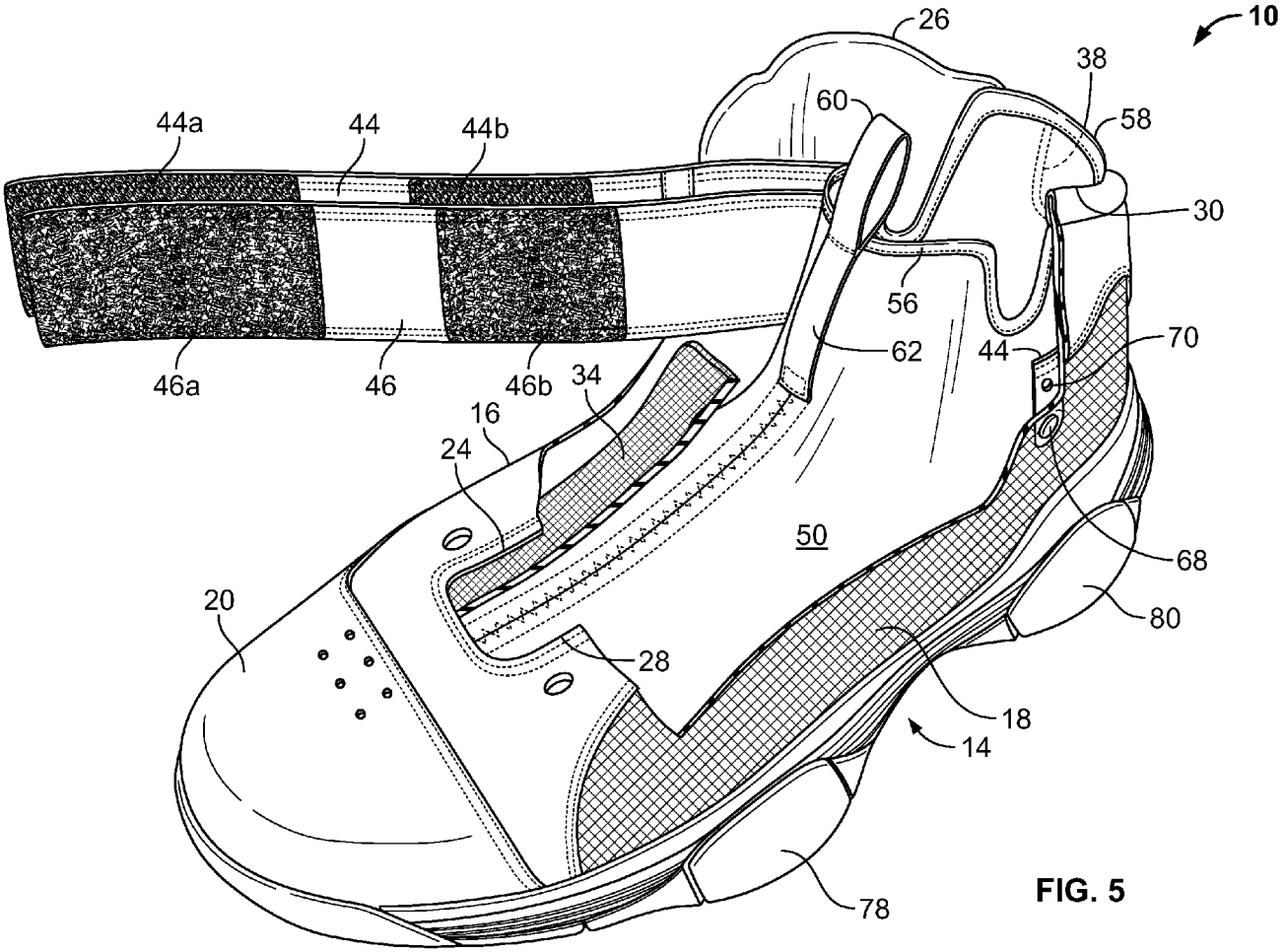
FIG. 5 is the perspective view of FIG. 1, with cutaways showing portions of the tongue and the inner boot liner of the shoe.

Referring back to the inner and outer straps 44, 46 shown in FIGS. 4 and 5, each strap has releasable fastening mechanisms, such as hook-and-loop fastening mechanisms, for securing themselves in place while providing support to the wearer's foot and ankle. More particularly, hook patches 44*a*, 46*a* and loop patches 44*b*, 46*b* are disposed on one side of the inner and outer straps 44, 46, respectively (see FIG. 5) to allow the wearer to bind and unbind the inner and outer straps 44, 46 easily. The inner strap 44 also includes an optional loop patch 44*c* disposed on the opposite side thereof (see FIG. 4) to increase the surface area on which the hook patch 46*a* of the outer strap 46 may attach when the outer strap 46 is being fastened by a wearer. The method by which the inner and outer straps 44, 46 fasten is described in further detail below.

Still referring to FIGS. 4 and 5, the inner and outer straps 44, 46 are each attached to the inside of the shoe 10 through conventional methods known in the art, such as sewing or riveting. The inner and outer straps 44, 46 are attached to the shoe 10 at points on the upper 12 and the sole 14 proximate the heel 22 such that the inner and outer straps 44, 46 are able to secure the sole 14 and the heel 22 of the upper 12 to the wearer's foot and ankle when the inner and outer straps 44, 46 are fastened. Both the inner and outer straps 44, 46 wrap around the wearer's ankle while the shoe is in use. The inner strap 44 is configured to cover the wearer's ankle, while the outer strap 46 is configured to cover the wearer's ankle mortise.

For instance, in the embodiment shown in FIGS. 4 and 5, the inner strap 44 is attached at one end to the lateral wall 18 proximate the heel 22 (i.e., at rivets 68 and rivet holes 70), while the outer strap 46 is attached at one end to the junction between the sole 14 and the medial wall 16 proximate the heel 22 (i.e., at strap seam 72). The inner strap 44 extends from the rivet 68 toward and around the inside of the heel 22, as well as around the outside of the liner heel 54. The inner strap 44 then extends along the inside of the medial wall 16, around the upper portion of the inner boot liner 50 proximate the front liner edge 56, underneath the tongue 34 and through an inner eyelet 74 located on the lateral wall 18. From the perspective of the wearer, the inner strap 44 originates at the lateral side of the wearer's ankle, extends behind the wearer's Achilles tendon and wraps around the front of the wearer's ankle before proceeding through the inner eyelet 74. Alternatively, the inner strap 44 may extend over the tongue 34 before being inserted through the inner eyelet 74 (see FIG. 9 and its associated discussion below for a more detailed description of this alternate embodiment).

The outer strap 46 extends from the strap seam 72 upwardly along the medial wall 16, over the upper portion of the inner boot liner 50, underneath the inner strap 44, through the inner boot strap loop 62 and through an outer eyelet 76 located on the lateral wall 18 proximate the inner eyelet 74. From the perspective of the wearer, the outer strap 44 begins at the arch of the wearer's foot proximate the wearer's heel and extends up and directly over the wearer's ankle mortise before proceeding through the outer eyelet 76. This configuration allows the inner and outer straps 44, 46 to secure the wearer's foot against the heel 22 of the shoe 10 and prevent the wearer's foot from sliding forward inside the shoe 10, thereby supporting the ankle's lateral ligaments and inhibiting the wearer's ankle from inverting.

With reference to FIGS. 1-3, the inner and outer straps 44, 46 are fed through the inner and outer eyelets 74, 76, respectively, enabling the inner and outer straps 44, 46 to cooperate with the buckle 48 to secure the wearer's foot and ankle inside the shoe 10. First, the inner strap 44 is positionable so as to be crossed over the instep of the shoe 10 (i.e., the medial and lateral instep edges 24, 28) and fed through the buckle 48 via the lower buckle slot 48*a*. The inner strap 44 is then fed back through the buckle 48 via the upper buckle slot 48*b*, is cinched tight and is then fastened to itself (i.e., by attaching the inner strap hook patch 44*a* to the inner strap loop patch 44*b*). Second, the outer strap 46 is positionable so as to be crossed over the instep of the shoe 10, fed through the buckle 48 via the upper buckle slot 48*b* and cinched tight. The outer strap 46 is then wrapped over the buckle 48 and is fastened to itself (i.e., by attaching the outer strap hook patch 46*a* to the outer strap loop patch 46*b*). Alternatively, the outer strap 46 may be fastened to the inner strap 44 (i.e., by attaching the outer strap hook patch 46*a* to the loop patch 44*c* on the inner strap 44). As a further alternative, the outer strap hook patch 46*a* may be attached to both the outer strap loop patch 46*b* and the inner strap loop patch 44*c* simultaneously. Other details concerning how the inner and outer straps 44, 46 are secured are described in U.S. Pat. No. 6,775,929 B2, the disclosure of which is incorporated by reference herein in its entirety.

Referring to FIG. 1, the shoe 10 also includes anterior and posterior lateral bumper supports 78, 80 located on the lateral side of the sole 14 (i.e., proximate the lateral wall 18). The anterior lateral bumper support 78 is located proximate the toe 20 of the shoe 10, while the posterior lateral bumper support 80 is located proximate the heel 22 of the shoe 10. The lateral bumper supports 78, 80 help inhibit ankle inversion by providing a wider surface area to the sole 14 of the shoe 10, thereby increasing the leverage the shoe 10 has against inversion during use. In sum, the lateral bumper supports 78, 80 provide support to the wearer's ankle in addition to that of the inner and outer straps 44, 46 and the inner boot liner 50.

The lateral bumper supports 78, 80 are integrally molded to the sole 14 of the shoe 10 and are generally constructed in the manner discussed in U.S. Pat. No. 6,775,929 B2, the disclosure of which is incorporated by reference herein in its entirety. Additionally, the lateral bumper supports 78, 80 are made of a rubber material that is softer and has a lower hardness than the material of the sole 14. For example, in one embodiment, the outsole 14*b* of the sole 14 has a durometer within the range of 59 A to 65 A, while the lateral bumper supports 78, 80 have durometers within the range of 52 A to 58 A. The softer material of the lateral bumper supports 78, 80 improves their shock absorption characteristics, thereby providing a greater cushioning effect for the shoe 10 when the wearer's foot takes off from and lands on the ground.

With reference to FIG. 7, the lateral bumper supports 78, 80 are slightly elevated from the ground by a distance D in comparison with the bottom of the sole 14 of the shoe 10. The distance D between the bottom of the elevated lateral support bumpers 78, 80 and the bottom of the sole 14 is in a range from about 1 mm to about 3 mm. The elevated nature of the lateral bumper supports 78, 80 helps decrease the amount of contact they make with the ground during ordinary use of the shoe 10, which helps reduce the wear experienced by the lateral bumper supports 78, 80 during such use. The elevated lateral bumper supports 78, 80 also provide a lever effect whereby inversion of the shoe 10 is inhibited.

Figure 8:
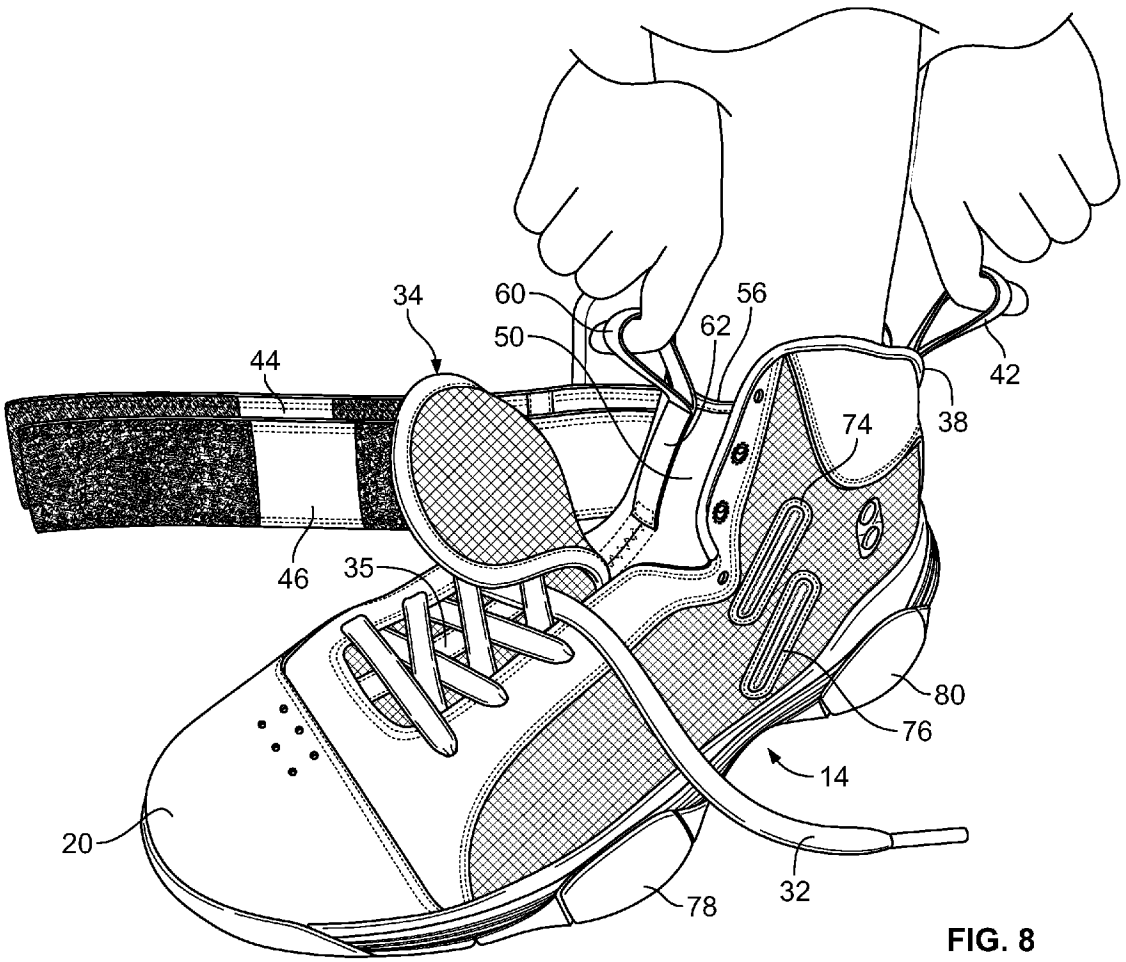
FIG. 8 is a perspective view of the athletic shoe shown in FIG. 1 exhibiting how the athletic shoe is put on by a wearer.

FIG. 8 shows one method of wearing the shoe 10. With the shoelace 32 untied and loosened and the inner and outer straps 44, 46 unfastened, the wearer places one finger in the front finger loop 60 and a second finger in the heel finger loop 42. The wearer then pulls the front and heel finger loops 60, 42 away from each other, thereby stretching the front ankle liner edge 56 away from the rear liner edge 58. The wearer then places his or her foot into the opening 40 of the shoe 10 and between the front liner edge 56 and the rear liner edge 58. The wearer may then pull upwardly on the front and heel finger loops 60, 42 to facilitate full insertion of his or her foot into the inner boot liner 50. Alternatively, the wearer may simply hold the lateral edges of the opening 40 wide while placing his or her foot therein and use the front and heel finger loops 60, 42 to straighten the inner boot liner 50 against the wearer's foot in case the inner boot liner 50 buckles (i.e., gets "bunched up") in the process. Once the wearer's foot has been placed inside the inner boot liner 50 such that the bottom of the wearer's foot is adjacent the sole 14 of the shoe 10, the wearer may then secure the shoe to his or her foot by tightening and tying the shoelace 32 and fastening the inner and outer straps 44, 46 in the manner described above.

It should be understood that the present invention can have many variations. For instance, in one embodiment, the lateral bumper supports 78, 80 can be detachable and reattachable in reference to the sole 14 of the shoe 10 (see detached posterior lateral bumper support 80 in FIG. 6). This embodiment allows the lateral bumper supports 78, 80 to be removed from the shoe 10 if they are not deemed desirable for a particular application, or replaced if they become damaged as a result of excessive wear. In one embodiment, the lateral bumper supports 78, 80 are attached and detached from the sole 14 using a male-female releasable coupling mechanism or a releasable detent clip.

In one embodiment, the lateral bumper supports 78, 80 are positioned lower, so as to be flush with bottom surface of the sole 14 in order to increase the traction the shoe 10 has with the ground surface. In another embodiment, the lateral bumper supports 78, 80 are height adjustable, thereby allowing the wearer to choose whether or not he/she wishes to have increased traction with the ground.

In one embodiment, the lateral bumper supports 78, 80 may be loaded with weights for the purpose of weight training while running or exercising the lower half of the wearer's body. In another embodiment, the lateral bumper supports 78, 80 may be placed on the medial side of the sole 14.

Figure 9:
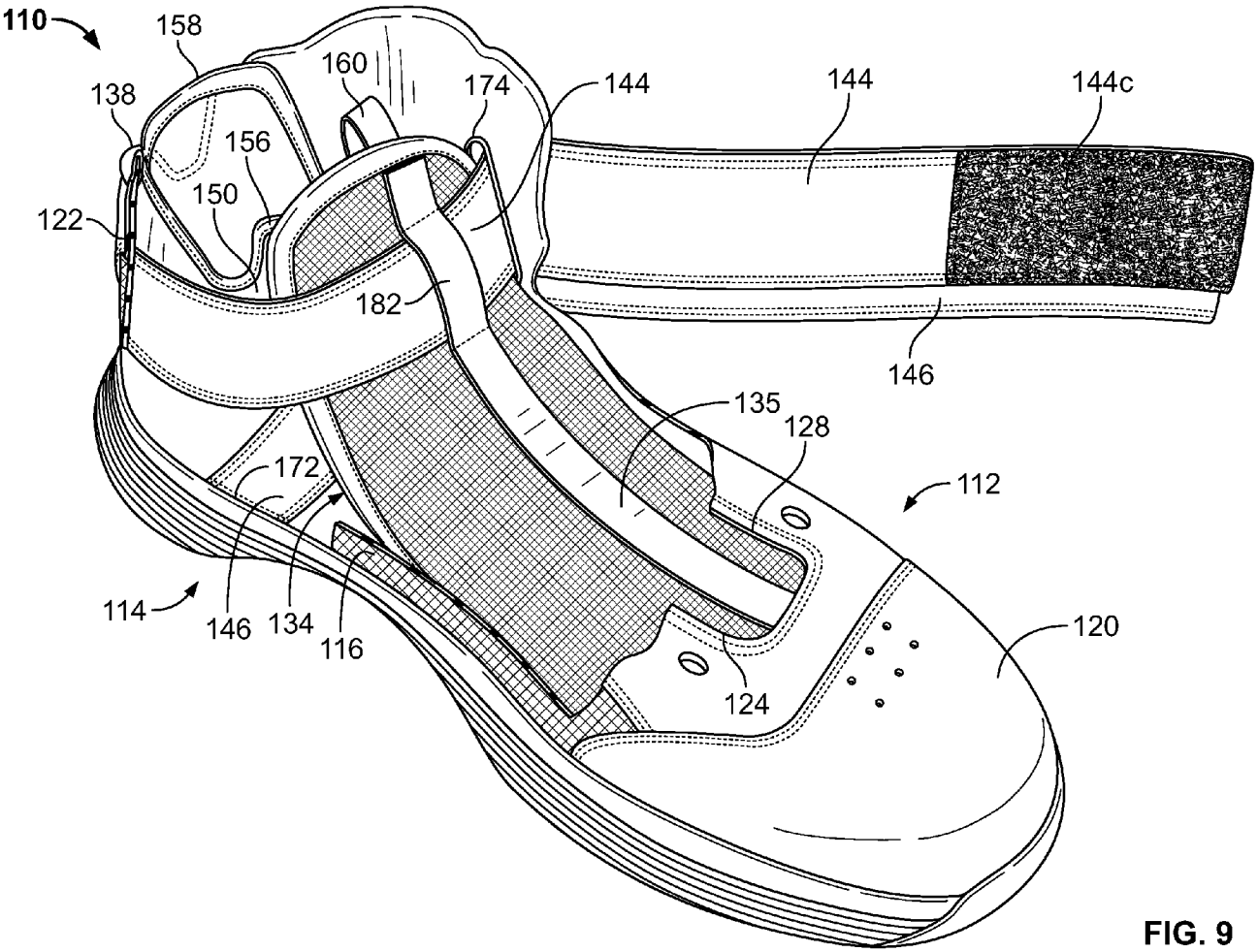
FIG. 9 is a perspective view of a medial side of an athletic shoe in accordance with a second embodiment of the present invention with cutaways showing portions of the tongue and the inner boot liner of the shoe.

FIG. 9 illustrates a second embodiment of the present invention. The elements illustrated in FIG. 9, which correspond to the elements described above with reference to FIGS. 1-8, have been designated by corresponding reference numerals increased by one hundred, while new elements are designated by reference numerals above reference numeral 180. The embodiment shown in FIG. 9 operates and is constructed in a manner consistent with the embodiment of FIGS. 1-8, unless otherwise indicated.

With reference to the embodiment shown in FIG. 9, the inner strap 144 of the shoe 110 may be placed over the tongue 134 before being inserted through the inner eyelet 174. In this embodiment, the tongue 134 serves as a buffer between the inner strap 144 and the outer strap 146, thereby allowing the wearer of the shoe 110 to tighten each of the inner and outer straps 144, 146 without creating friction between the two straps. In order to inhibit the inner strap 144 from shifting up or down relative to the tongue 134, the center tongue strip 135 includes a tongue strap loop 182 that is sized and shaped to accommodate and secure the inner strap 144 against the tongue 134. In another embodiment, the center tongue strip 135 has no strap loop to accommodate the inner strap 144, thereby allowing the inner strap 144 to be tightened without the extra friction created by a strap loop.

FIGS. 10-16 illustrate a third embodiment of the present invention. The elements illustrated in FIGS. 10-16, which correspond to the elements described above with reference to FIGS. 1-8, have been designated by corresponding reference numerals increased by two hundred, The embodiment shown in FIGS. 10-16 operates and is constructed in a manner consistent with the embodiment of FIGS. 1-8, unless otherwise indicated below.

The shoe 210 includes an upper 212 and a sole 214 in fixed attachment. The upper 212 has a medial wall 216 and a lateral wall 218, which join at the anterior end of the shoe 210 to form a toe 220 and at the posterior end of the shoe 210 to form a heel 222. The shoe 210 also includes a tongue 234, which is attached to the upper 212 proximate the toe 220. The medial and lateral walls 216, 218, the tongue 234 and the heel 222 form a foot opening 240, in which a wearer may place his or her foot to wear the shoe 210. The medial wall 216 has a medial instep edge 224 proximate the toe 220 and a medial ankle edge 226 proximate the heel 222. Likewise, the lateral wall 218 has a lateral instep edge 228 proximate the toe 220 and a lateral ankle edge 230 proximate the heel 222. The medial and lateral instep edges 224, 228 form the instep of the shoe 210. The shoe 210 also includes anterior and posterior lateral bumper supports 278, 280 located on the lateral side of the sole 214 (i.e., proximate the lateral wall 218) that are integrally molded to the sole 214 of the shoe 210, and are generally constructed in the manner discussed in U.S. Pat. No. 6,775,929, the disclosure of which is incorporated by reference herein in its entirety.

The shoe 210 includes an inner strap 244 and an outer strap 246, both of which overlie the instep of the shoe 210 (i.e., the medial and lateral instep edges 224, 228). The inner and outer straps 244, 246 are each attached at one end to the lateral wall 218 of the shoe 210, and each of the straps 244, 246 has a free end that is fastened to or proximate the medial wall 216 to secure the sole 214 and the heel 222 of the upper 212 to the wearer's foot and ankle, thereby supporting same and reducing the likelihood of injury to the wearer.

Figure 10:
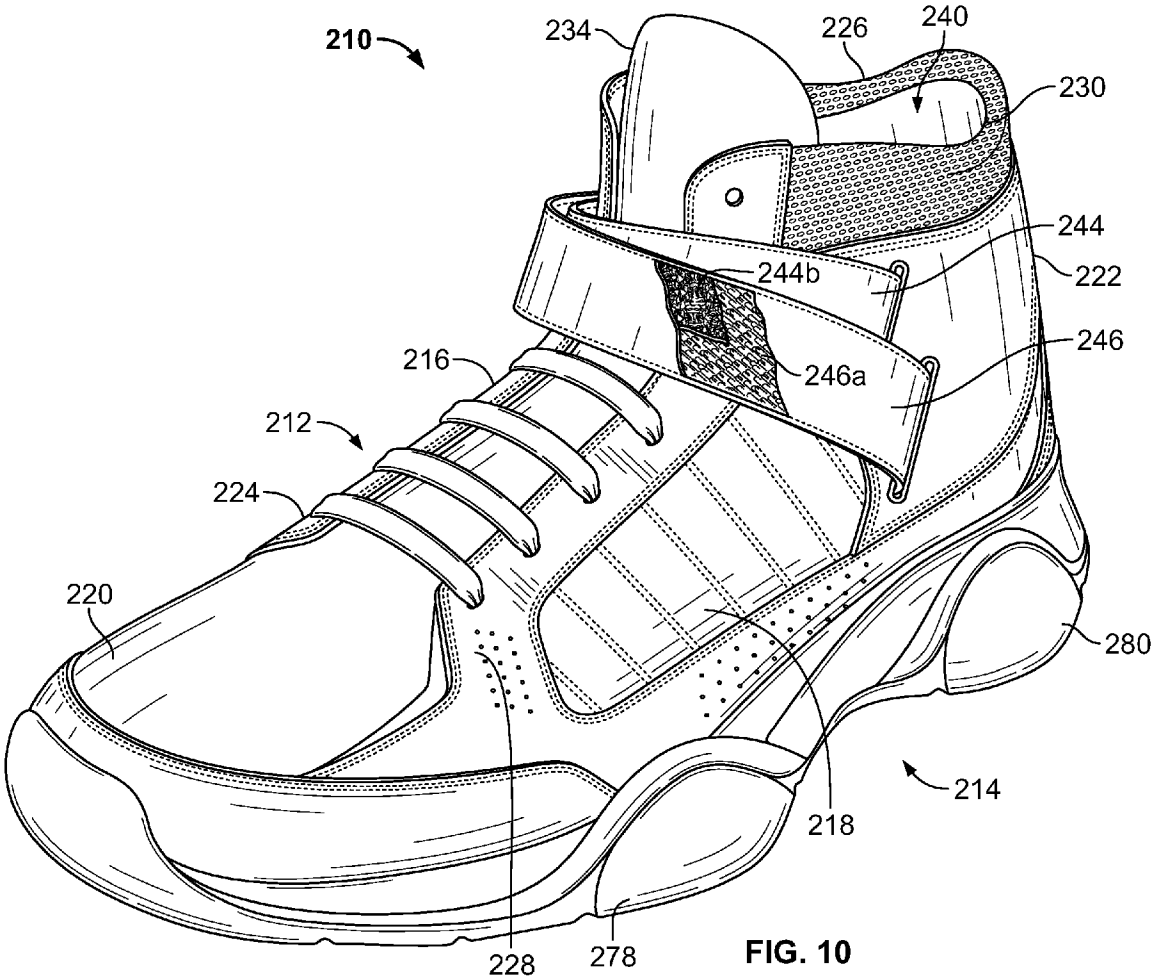
FIG. 10 is a perspective view of a lateral side of an athletic shoe in accordance with a third embodiment of the present invention, with a cutaway showing hook and loop fasteners on straps of the shoe.
Figure 11:
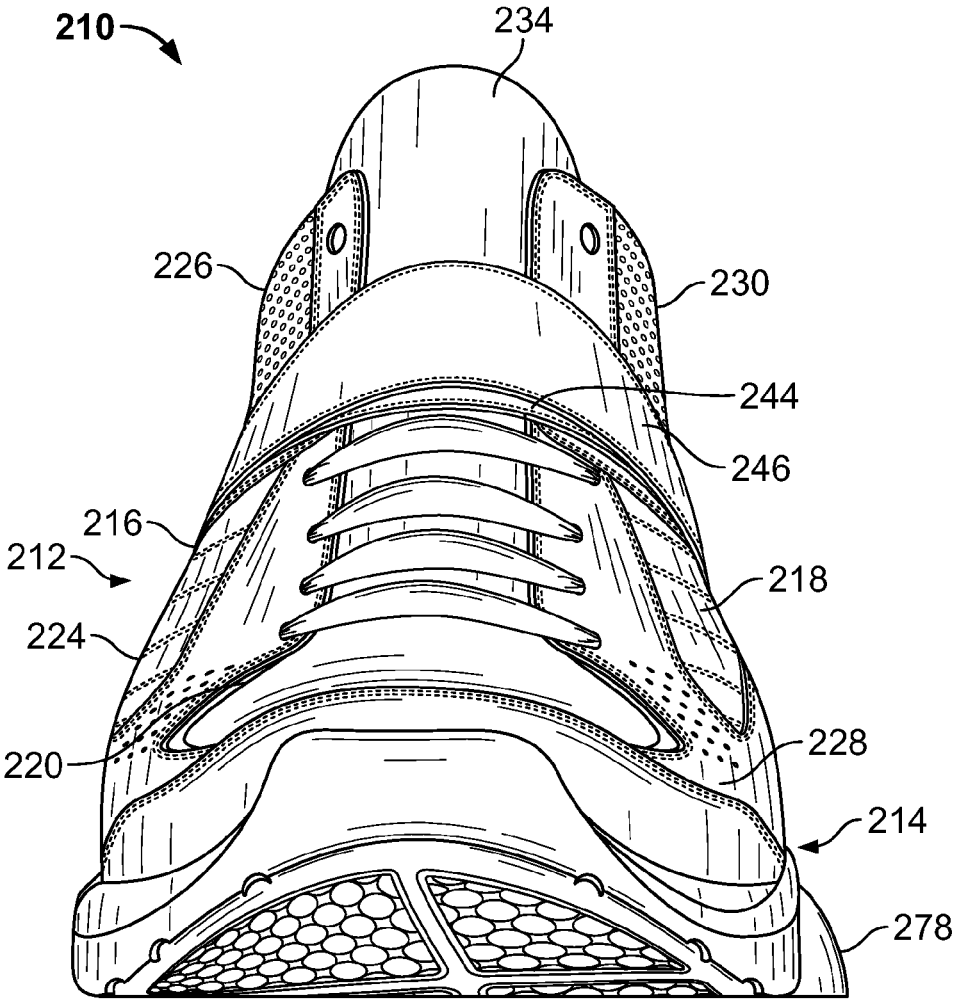
FIG. 11 is a front elevational view of the athletic shoe shown in FIG. 10.
Figure 12:
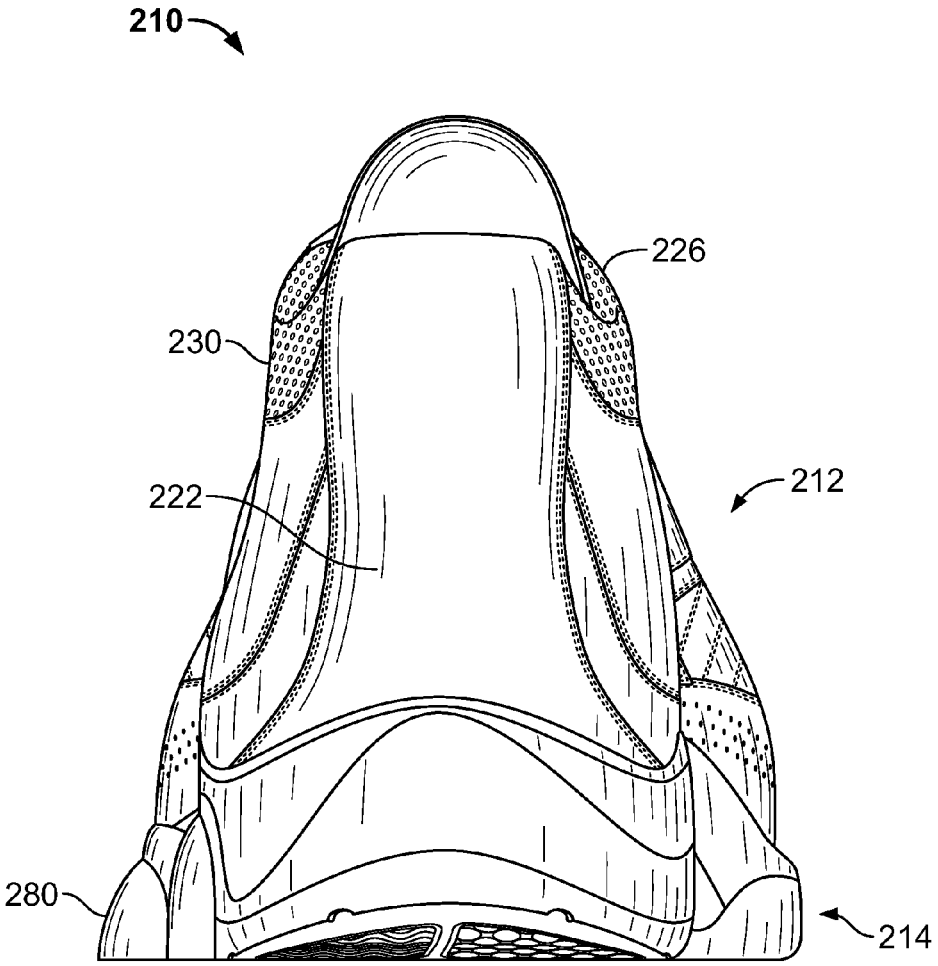
FIG. 12 is a rear elevational view of the athletic shoe shown in FIG. 10.
Figure 13:
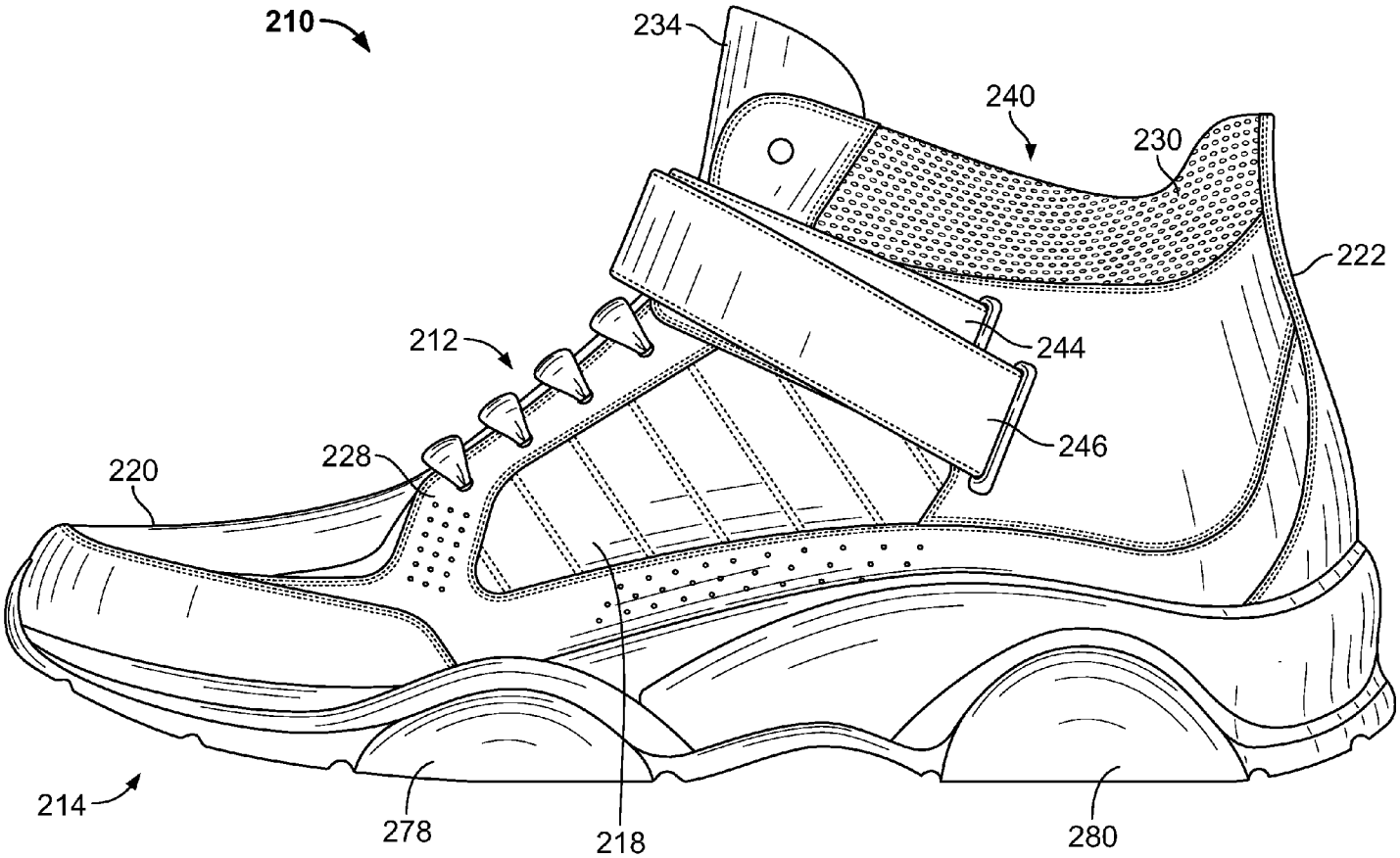
FIG. 13 is a lateral side view of the athletic shoe shown in FIG. 10.
Figure 14:
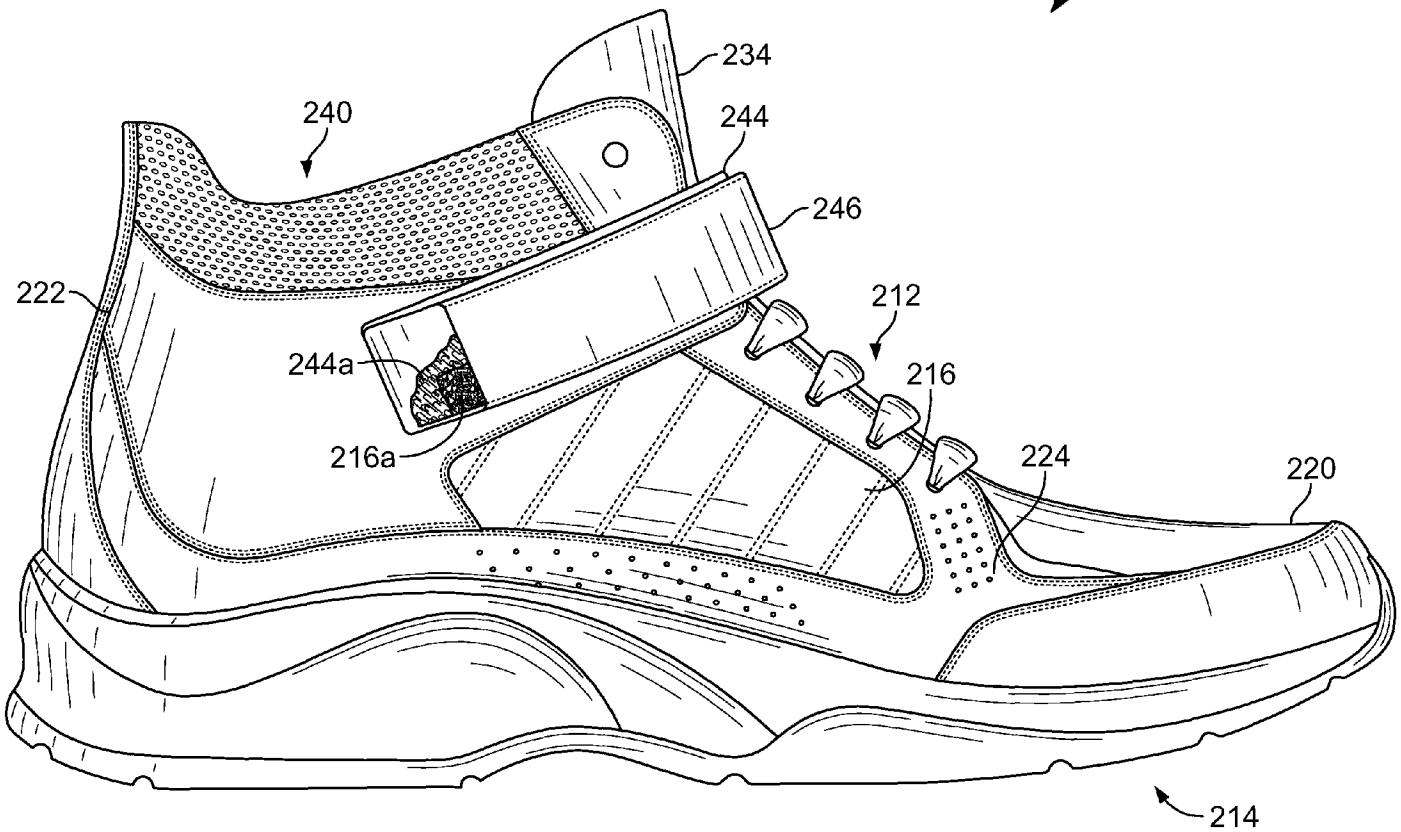
FIG. 14 is a medial side view of the athletic shoe shown in FIG. 10, with a cutaway showing hook and loop fasteners on the shoe and a strap thereof.
Figure 15:
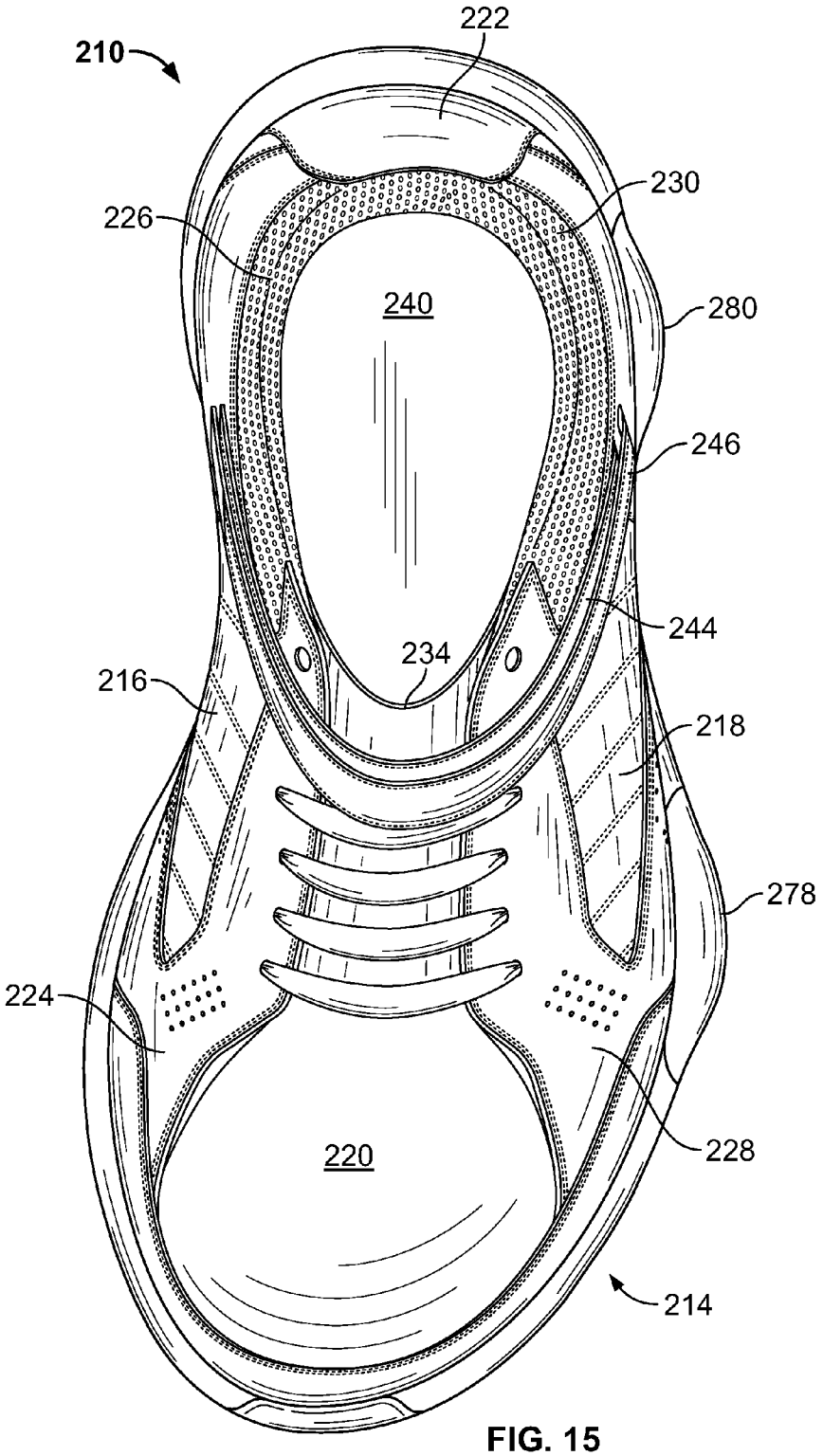
FIG. 15 is a top plan view of the athletic shoe shown in FIG. 10.
Figure 16:
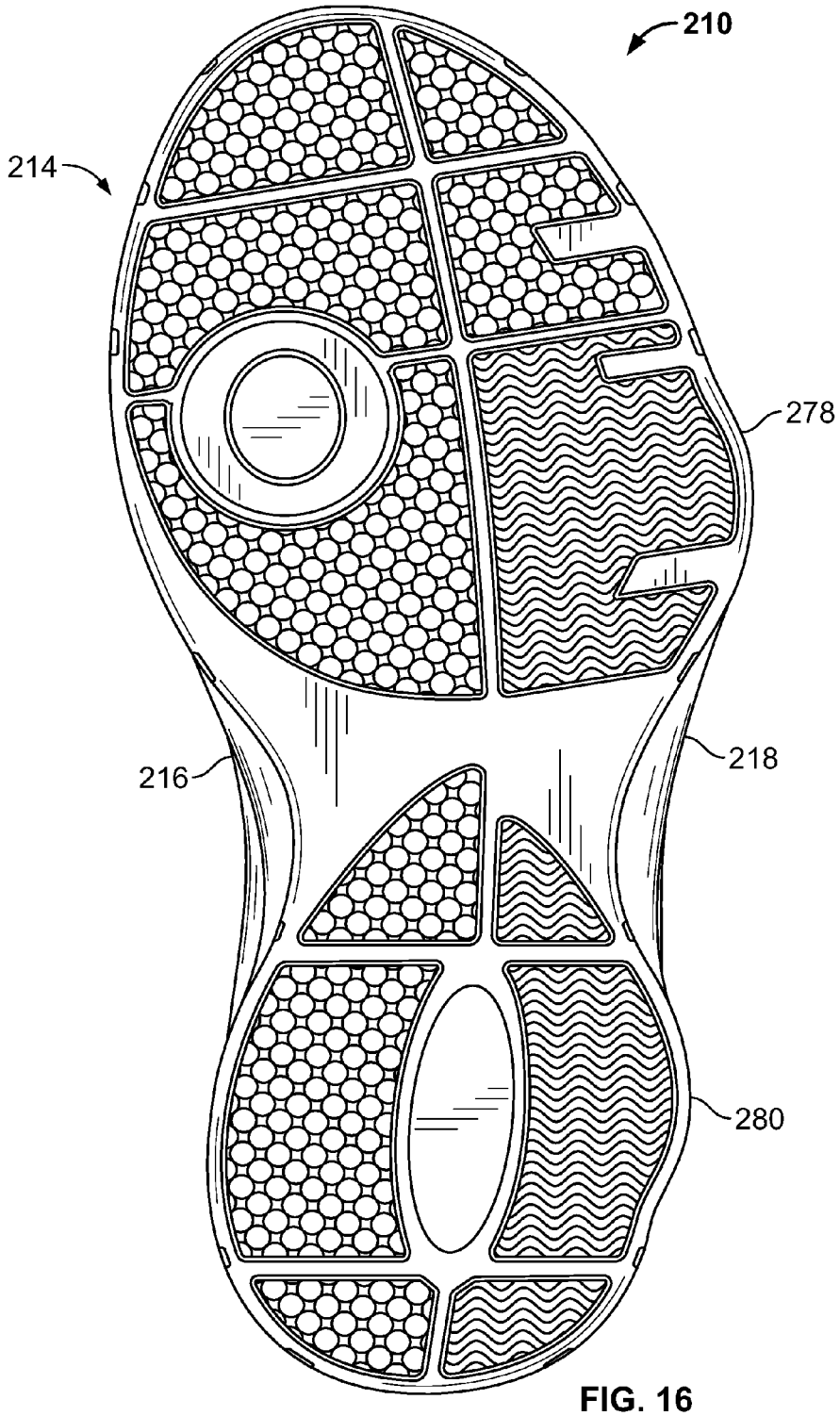
FIG. 16 is a bottom plan view of athletic shoe shown in FIG. 10.

Each of the inner and outer straps 244, 246, has releasable fastening mechanisms, such as hook-and-loop fasteners, which cooperate with each other and also with a similar fastener on the medial wall 216. More particularly, a loop patch **216*a* is disposed on the medial wall 216 of the shoe 210 (see FIG. 14) and a hook patch 244*a* is disposed on an inner side of the inner strap 244 proximate the free end thereof, which allows a wearer to bind and unbind the inner strap 244 to the medial wall 216 easily. Referring now to FIG. 10, a loop patch 244*b* is disposed on an outer side of the inner strap 244, and a hook patch 246*a* is disposed on an inner side of the outer strap 246, which allows the wearer to bind and unbind the outer strap 246 easily. The method by which the inner and outer straps 244, 246** fasten is described in further detail below.

A wearer inserts his or her foot into the shoe 210 through the opening 240. The inner and outer straps 244, 246 are then extended away from the lateral wall 218 and secured to or proximate the medial wall 216. More particularly, the inner strap 244 is extended away from the lateral wall 218 and secured to the medial wall 216 (e.g., by hook-and-loop fasteners **216*a* and 244*a* described above), and the outer strap 246 is then extended away from the lateral wall 218 and secured to the inner strap 244 (e.g., by hook-and-loop fasteners 244*b* and 246*a* described above) proximate the medial wall 216. The inner and outer straps 244, 246** function as additional support for the wearer's ankle, as discussed above.

It will be understood that the embodiments and methods described herein are merely exemplary of the present invention and that a person skilled in the art may make many variations and modifications without departing from the spirit and scope of the invention. All such variations and modifications are intended to be included within the scope of the invention and the scope of the appended claims.

We claim:

1. An athletic shoe, comprising:

a sole at the bottom of said shoe:

an upper attached to said sole and extending upwardly therefrom, said upper including a medial wall on one side of said shoe, said medial wall having a medial instep edge and a medial ankle edge, a lateral wall on an opposite side of said shoe, said lateral wall having a lateral instep edge, a lateral ankle edge, a first eyelet located between said sole and said lateral ankle edge and a second eyelet located intermediate said sole and said first eyelet, said medial wall being joined to said lateral wall at an anterior end of said shoe to form a shoe toe proximate said medial instep edge and said lateral instep edge, said medial wall further being joined to said lateral wall at a posterior end of said shoe to form a shoe heel proximate said medial ankle edge and said lateral ankle edge, and said medial wall including a single buckle positioned on an outer surface of said medial wall between said sole and said medial ankle edge, said buckle having an upper buckle slot and a lower buckle slot directly below said upper buckle slot;

a tongue including one end attached to said upper proximate said shoe toe, and a tongue edge opposite said one end of said tongue and proximate said medial ankle edge and said lateral ankle edge;

a shoelace positioned above said tongue and insertably engaging said medial instep edge and said lateral instep edge, said medial and lateral instep edges forming an instep of said shoe when secured in proximity to one another by said shoelace;

a flexible inner boot liner attached to said sole and positioned under said tongue, said inner boot liner extending laterally between said medial wall and said lateral wall and including a liner heel positioned adjacent said shoe heel, and a front liner edge proximate said tongue edge and having a liner strap loop;

an inner strap configured to wrap around a wearer's ankle, said inner strap having one end attached to said lateral wall at a first attachment site located between said shoe heel and said first and second eyelets and between said sole and said lateral ankle edge, said inner strap being extendable between an inner surface of said shoe heel and an outer surface of said liner heel, between said medial wall and said inner boot liner, past said tongue, and through said first eyelet, wherein a first portion of said inner strap extendable through and beyond said first eyelet externally of said shoe is positionable over said lateral instep edge, said tongue, said shoelace, and said medial instep edge, said inner strap having a length sufficiently long to allow a second portion of said inner strap to pass through said lower and upper buckle slots and to extend back over said first portion of said inner strap in an overlapping relationship with respect to each other;

an outer strap configured to wrap around a wearer's ankle mortise, said outer strap having one end attached to a junction between said sole and said medial wall at a second attachment site located proximate said shoe heel, said outer strap being extendable between said medial wall and said inner boot liner, between said inner boot liner and said tongue, through said liner strap loop beneath said inner strap, and through said second eyelet, wherein a first portion of said outer strap extendable through and beyond said second eyelet externally of said shoe is positionable over said second portion of said inner strap in an overlapping fashion, said outer strap having a length sufficiently long to allow a second portion of said outer strap to pass through said upper buckle slot and to extend back over said first portion of said outer strap in an overlapping relationship with respect to each other; and fastening means for fastening said inner and outer straps in an overlapping relationship with respect to said instep of said shoe, said fastening means including a first fastening mechanism disposed on said inner strap, said first fastening mechanism including a first hook patch located on one of said first and second portions of said inner strap and a first loop patch located on the other of said first and second portions of said inner strap and arranged so as to be removeably attachable to said first hook patch when said first and second portions of said inner strap are in said overlapping relationship with respect to each other, and a second fastening mechanism disposed on said outer strap, said second fastening mechanism including a second hook patch located on one of said first and second portions of said outer strap and a second loop patch located on the other of said first and second portions of said outer strap and arranged so as to be removeably attachable to said second hook patch when said first and second portions of said outer strap are in said overlapping relationship with respect to each other.

2. The athletic shoe of claim 1, wherein said sole includes an interior lateral bumper support proximate said lateral wall and said shoe toe, and a posterior lateral bumper support proximate said lateral wall and said shoe heel.

3. The athletic shoe of claim 2, wherein said anterior lateral bumper support and said posterior lateral bumper support are slightly elevated from the ground by a distance in comparison with a bottom of said sole.

4. The athletic shoe of claim 3, wherein said distance is in a range from about 1 mm to about 3 mm.

5. The athletic shoe of claim 1, wherein said one end of said inner strap is attached by rivets to said lateral wall, and wherein said one end of said outer strap is attached by a strap seam at said junction between said sole and said medial wall.

6. The athletic shoe of claim 1, wherein said inner boot liner includes a first finger loop proximate said tongue and a second finger loop proximate said shoe heel.

7. The athletic shoe of claim 1, wherein said inner strap is extendable over said tongue.

8. The athletic shoe of claim 7, wherein said tongue includes a center tongue strip having a tongue strap loop that is sized and shaped to accommodate and secure said inner strap against said tongue, whereby said inner strap is extendable through said tongue strap loop when passing over said tongue.

9. The athletic shoe of claim 1, wherein said inner strap is extendable under said tongue.

10. The athletic shoe of claim 1, wherein said first hook patch and said first loop patch are disposed on one and the same side of said inner strap, said one and the same side of said inner strap facing away from said instep of said shoe when said inner strap is being extended from said inner eyelet to said buckle.

11. The athletic shoe of claim 10, wherein said second hook patch and said second loop patch are disposed on one and the same side of said outer strap, said one and the same side of said outer strap facing away from said instep of said shoe when said outer strap is being extended from said outer eyelet to said buckle.

12. The athletic shoe of claim 11, wherein said fastening means includes a third fastening mechanism for releasably fastening said inner and outer straps to each other when said inner and outer straps are in said overlapping relationship with respect to said instep of said shoe.

13. The athletic shoe of claim 12, wherein said first loop patch is located on said first portion of said inner strap, said first hook patch is located on said second portion of said inner strap, said second loop patch is located on said first portion of said outer strap, and said second hook patch is located on said second portion of said outer strap.

14. The athletic shoe of claim 13, wherein said third fastening mechanism includes a third loop patch on an opposite side of said inner strap, said third loop patch being positioned on said second portion of said inner strap such that said third loop patch is removeably attachable to said second hook patch when said inner and outer straps are in said overlapping relationship with respect to said instep of said shoe.

15. The athletic shoe of claim 1, wherein said inner boot liner is made from a material that wicks perspiration.

16. The athletic shoe of claim 15, wherein said inner boot liner is made from neoprene.

* * * * *